US009440370B2

(12) United States Patent
Hayden

(10) Patent No.: US 9,440,370 B2
(45) Date of Patent: Sep. 13, 2016

(54) RE-CIRCULATING SYSTEM FOR SLURRIED ABRASIVE/LIQUID FEED TO MULTIPLE ABRASIVE WATER JET CUTTING HEADS

(71) Applicant: Mark William Hayden, Monroe, CT (US)

(72) Inventor: Mark William Hayden, Monroe, CT (US)

( * ) Notice: Subject to any disclaimer, the term of this patent is extended or adjusted under 35 U.S.C. 154(b) by 5 days.

(21) Appl. No.: 14/310,550

(22) Filed: Jun. 20, 2014

(65) Prior Publication Data

US 2014/0378028 A1 Dec. 25, 2014

Related U.S. Application Data

(60) Provisional application No. 61/956,901, filed on Jun. 20, 2013.

(51) Int. Cl.

| | |
|---|---|
| ***B24C 7/00*** | (2006.01) |
| ***B26F 1/26*** | (2006.01) |
| ***B26F 3/00*** | (2006.01) |
| ***B24C 1/04*** | (2006.01) |

(52) U.S. Cl.

CPC ..... *B26F 3/004* (2013.01); *B24C 1/045* (2013.01); *B24C 7/0023* (2013.01)

(58) Field of Classification Search

CPC .... B24C 1/045; B24C 7/0023; B24C 7/0015
USPC ..... 451/2, 5, 75, 87, 88, 99, 40
See application file for complete search history.

(56) References Cited

U.S. PATENT DOCUMENTS

| | | | | |
|---|---|---|---|---|
| 2,985,050 | A * | 5/1961 | Schwacha | B26F 3/004 125/23.01 |
| 3,434,241 | A * | 3/1969 | Greenberg et al. | 451/2 |
| 3,500,591 | A * | 3/1970 | Keith | B24B 9/12 451/41 |
| 3,852,918 | A * | 12/1974 | Black | 451/99 |
| 4,669,230 | A * | 6/1987 | Suzuki | B24C 7/0015 451/100 |
| 4,872,293 | A * | 10/1989 | Yasukawa | B24C 1/045 451/75 |
| 4,955,164 | A * | 9/1990 | Hashish | B24C 1/045 451/40 |
| 5,178,496 | A * | 1/1993 | Trieb | B24C 7/0092 406/106 |
| 5,320,289 | A * | 6/1994 | Hashish et al. | 239/434 |
| 5,575,705 | A * | 11/1996 | Yam et al. | 451/39 |
| 6,676,039 | B2 | 1/2004 | Lindsey et al. | |
| 7,934,977 | B2 * | 5/2011 | Hashish | 451/36 |
| 2005/0126472 | A1 * | 6/2005 | Popescu | B24C 1/045 117/200 |
| 2012/0217011 | A1 * | 8/2012 | Dotson | E21B 43/114 166/305.1 |
| 2014/0094093 | A1 | 4/2014 | Miller | |

* cited by examiner

*Primary Examiner* — Monica Carter
*Assistant Examiner* — Marcel Dion
(74) *Attorney, Agent, or Firm* — Alix, Yale & Ristas, LLP

(57) ABSTRACT

A water abrasive slurry supply system permits abrasive recovery and reuse and allows for constant controlled supply of abrasive slurry to multiple cutting heads in series or in parallel from a remote common slurry mix/supply tank. By keeping the slurry mix always in constant motion the abrasive is not allowed to settle out of suspension. The velocity required to maintain suspension in the recirculating loop is 6 to 7 feet per second.

5 Claims, 3 Drawing Sheets

RE-CIRCULATING SYSTEM FOR SLURRIED ABRASIVE/LIQUID FEED TO MULTIPLE ABRASIVE WATER JET CUTTING HEADS

BACKGROUND

This invention relates to the field of abrasive waterjet cutting. More specifically, the invention relates to a system allowing for the controlled use of abrasive transferred to the cutting surface in a liquid slurry format.

Waterjet cutting of materials consists of focusing a coherent stream of water under high pressure (10,000-125,000 PSI) through a small (0.003-0.063") opening against a surface to be cut. The velocity of the water stream is directly proportional to the pressure differential across the opening in the jewel (Ruby, Sapphire or Diamond) placed in the entry face of the focusing nozzle. Soft materials such as plastics, fabrics and wood are successfully cut by this method. Hard materials such as steel, concrete and ceramics can be readily cut up to a depth of 12" by adding abrasive particles to the accelerated water stream (Abrasive Waterjet) prior to exiting the focusing tube at speeds several times greater than the speed of sound.

Current systems for employing abrasive particles as an aid to waterjet cutting of materials almost exclusively consist of a dry abrasive supplied to the mix/focusing tube of a waterjet cutting nozzle by virtue of induced venturi pressure drawing dry abrasive granules from a supply hopper located in close proximity to the cutting head. Compressed air pressure is applied to the supply mini hopper to aid in the transfer of dry granules to the cutting head as a result of the venture effect. As distance from the supply hopper to the venturi source is increased, dry abrasive tends to clog the entry tube resulting in uneven abrasive mixing or total blockage of the abrasive entry. In many cases, the uneven feed causes blockage in the focusing tube causing liquid backup into the entry tube and supply hopper. Attempts to introduce abrasive granules in the form of a slurry have been largely unsuccessful due to settling of abrasive out of suspension in the water. Major problems with controlling abrasive delivery rate in processes attempted to date have frustrated all attempts to adopt a successful slurry feed system for use in this industry.

SUMMARY

The present invention overcomes the obstacle of supplying a continuous supply of consistent abrasive slurry mixture in close proximity to the post-jewel venturi mixing tube without reducing the pressure differential necessary to achieve maximum cutting speed in the focusing tube and simultaneously provides a water abrasive slurry supply system amenable to direct abrasive recovery and reuse. The present invention allows for constant controlled supply of abrasive slurry to multiple cutting heads in series or in parallel from a remote common slurry mix/supply tank. By keeping the slurry mix always in constant motion the abrasive is not allowed to settle out of suspension. The velocity required to maintain suspension in the recirculating loop is 6 to 7 feet per second.

DETAILED DESCRIPTION

Figure 1:
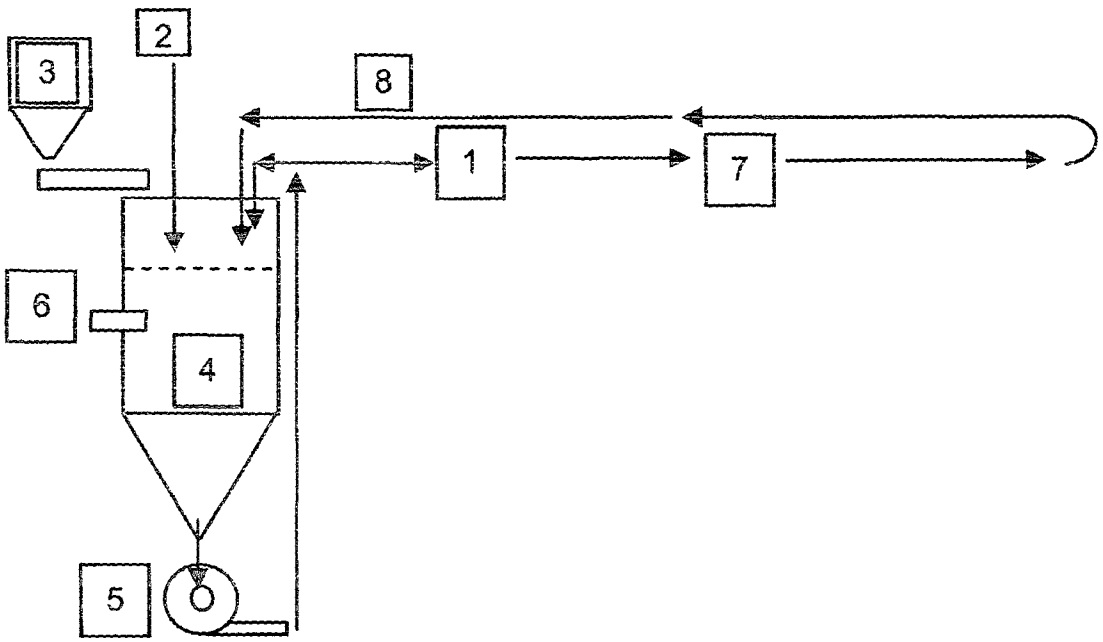
FIG. 1 illustrates an abrasive slurry supply system according to aspects of the disclosure.

FIG. 1 is schematic representation of a continuous abrasive slurry supply system where dry abrasive is metered from 0 to 2 pounds per minute as required (3) with return slurry and fresh water (2) to a common feed tank (4). Slurry density is monitored via an Ultrasonic Density Sensor (6) and adjusted through a feedback loop to adjust slurry solid/liquid density to preset conditions from 0.1% to 15%. A constant volume/pressure peristaltic pump (5) delivers slurry through a 0 to 50 psi pressure controlling valve (1) to a re-circulating PVC pipe loop (8) supplying multiple cutting heads (7). Excess volume delivered by pump (5) returns to the mix tank (4) along with re-circulating slurry in excess of cutting head requirements (8).

Figure 1A:
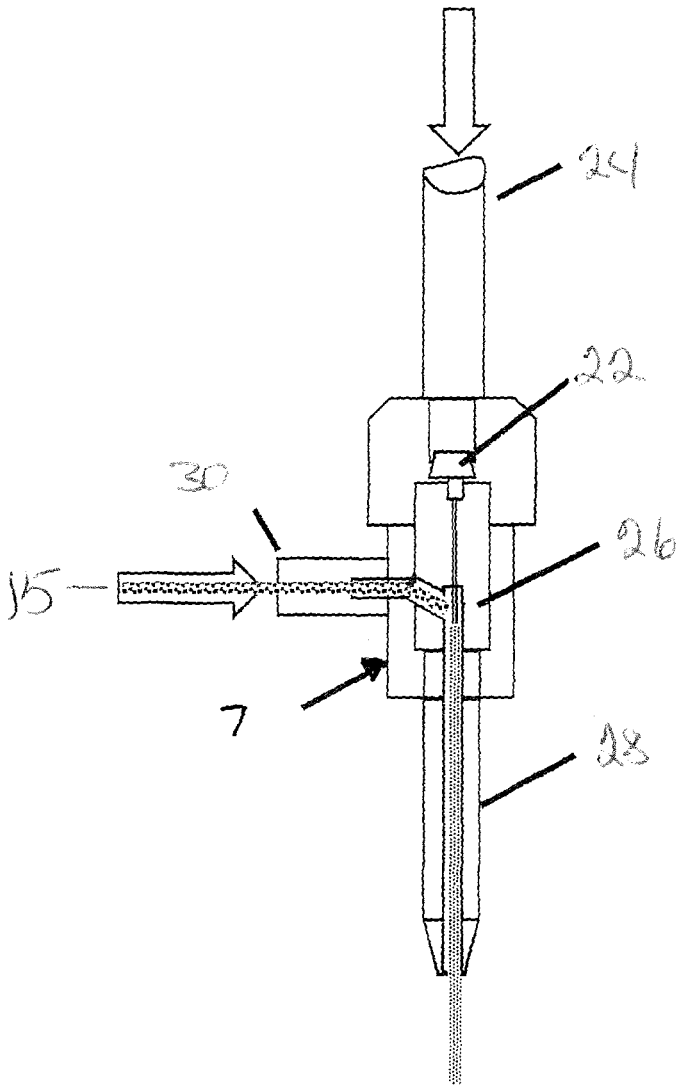
FIG. 1A is a representative waterjet cutting head compatible with the disclosed slurry supply system.

FIG. 1A illustrates a waterjet cutting head (7) compatible with the disclosed slurry feed system. The cutting head (20) includes a jewel orifice (22) to accelerate a pressurized flow of water (24), which then passes through a mixing chamber (26) and focusing nozzle (28). An abrasive inlet (30) is arranged to receive a slurry of water and abrasive (15) that is entrained in the high velocity water jet from the jewel orifice (22) and emitted from the waterjet cutting head (7).

Figure 2:
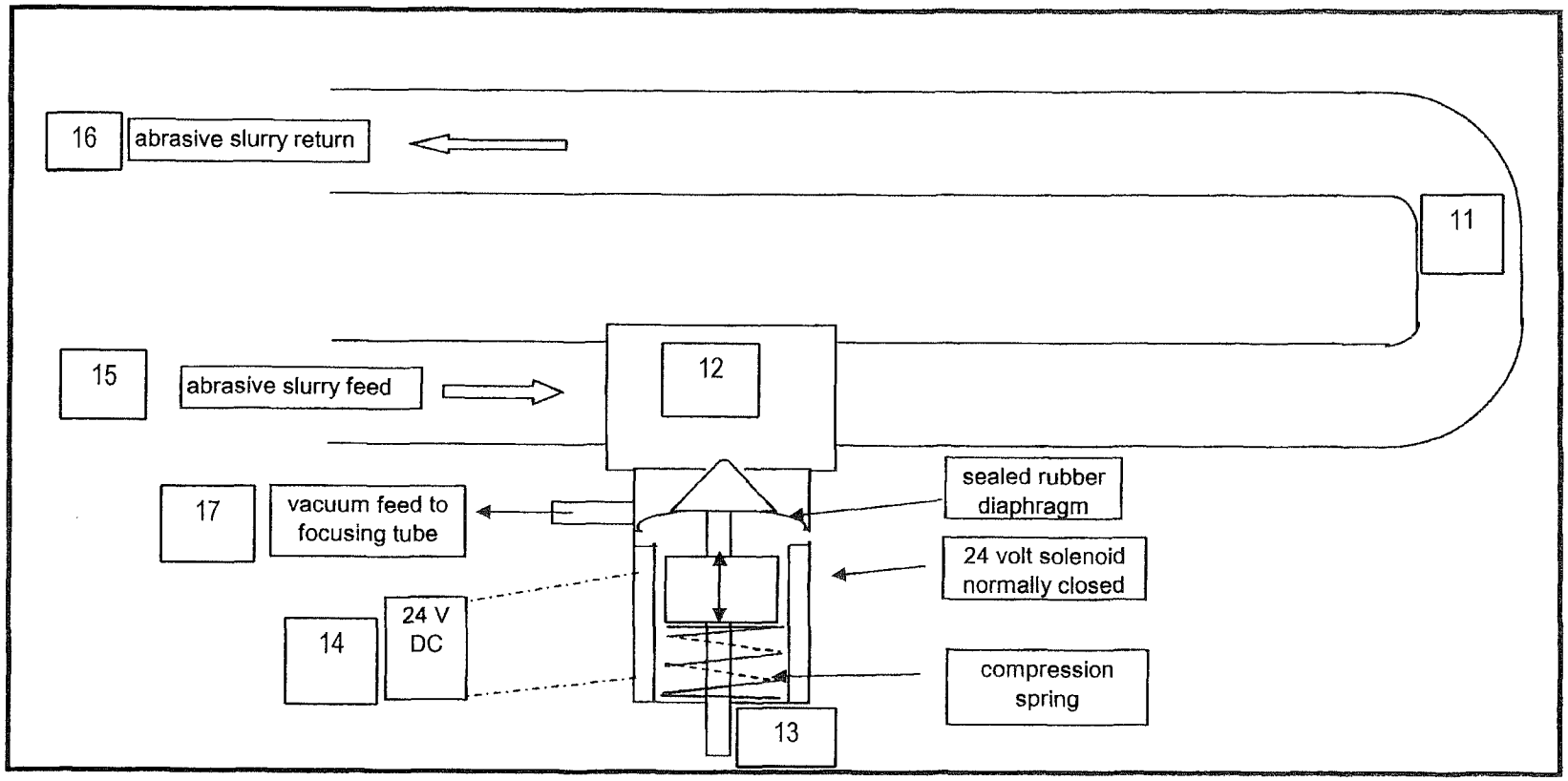
FIG. 2 illustrates an exemplary arrangement to feed abrasive slurry to a cutting head according to aspects of the disclosure.

FIG. 2 displays detailed arrangement of an individual cutting head supply according to aspects of the disclosure. A controlled pressure/viscosity/density slurry of water and abrasive (15) is delivered to the solenoid assembly (12) which is signaled to open on demand. A DC voltage activated, normally closed solenoid (13) is opened allowing a controlled flow of slurry under line pressure to be introduced to the venturi pressure (17) of the focusing tube. Pressure in the circulating supply pipe (11) is maintained slightly in excess of the induced vacuum of the venturi draft in order to preserve cutting velocity of the focusing nozzle. An orifice located in the valve above the shutoff provides the required pressure drop. A variety of orifices are provided and selected based on the flow characteristics of the cutting head i.e., cutting head orifice diameter, focusing tube diameter, and pressure drop across the cutting head orifice. The solenoid closure is activated via spring compression. A signal from the system controller removes the DC voltage (14) from the coil. The valve will stop the flow of the slurry mix to the cutting head via the spring pressure against a low durometer diaphragm valve with a shape surface which seats in the orifice opening. Unused abrasive slurry (16) is returned to the feed tank for recirculation.

What is claimed:

1. A waterjet cutting system comprising:

a waterjet cutting head including an orifice in fluid communication with a mixing chamber and a focusing nozzle, and an abrasive slurry inlet in fluid communication with said mixing chamber;

a source of high pressure water in communication with said orifice;

an abrasive reservoir for containing abrasive material;

a water supply;

a slurry mix supply tank remote from said waterjet cutting head;

metering valves for creating a controlled slurry of abrasive and water in said slurry mix supply tank;

a slurry supply loop beginning and ending at said slurry mix supply tank and in communication with said abrasive slurry inlet;

a pump for continuously circulating said slurry in said slurry supply loop at a velocity sufficient to maintain said abrasive suspended in said slurry, wherein a predetermined quantity of said slurry is entrained in and mixed with a stream of high pressure water emitted from said orifice and slurry not delivered to said waterjet cutting head is returned to said slurry mix supply tank.

2. The waterjet cutting system of claim 1, comprising a density sensor arranged to detect the density of said slurry and a control system that receives inputs from said density sensor and controls said metering valves so that said slurry is maintained at a predetermined density and viscosity.

3. The waterjet cutting system of claim 1, wherein said pump maintains said slurry in said loop at a predetermined pressure greater than an induced vacuum at said abrasive slurry inlet.

4. The waterjet cutting system of claim 1, comprising a plurality of water jet cutting heads, each having an abrasive slurry inlet in fluid communication with said slurry supply loop.

5. The waterjet cutting system of claim 1, wherein a distance between the cutting head and the slurry mix supply tank is greater than a distance between the cutting head and the slurry supply loop.

* * * * *